United States Patent [19]

Memminger et al.

[11] Patent Number: 5,058,398

[45] Date of Patent: Oct. 22, 1991

[54] THREAD SUPPLY DEVICE FOR A CIRCULAR KNITTING MACHINE

[75] Inventors: Gustav Memminger, Freudenstadt; Falk Kühn, Rottenburg; Heinze Fabschitz, Westerham, all of Fed. Rep. of Germany

[73] Assignee: Sipra Patententwicklungs-und Beteiligungsgesellschaft, Albstadt, Fed. Rep. of Germany

[21] Appl. No.: 559,988

[22] Filed: Jul. 30, 1990

Related U.S. Application Data

[63] Continuation of Ser. No. 231,509, Aug. 12, 1988, abandoned.

[30] Foreign Application Priority Data

Aug. 15, 1987 [DE] Fed. Rep. of Germany ..... 3727249

[51] Int. Cl.[5] ..... D04B 15/48; D04B 15/62; D04B 27/20

[52] U.S. Cl. ..... 66/132 R; 66/138; 66/144; 66/146

[58] Field of Search ..... 66/8, 125 R, 10, 81, 66/132 R, 144, 146, 138; 28/190, 194

[56] References Cited

U.S. PATENT DOCUMENTS

| | | | |
|---|---|---|---|
| 140,635 | 7/1873 | Merrill | 66/10 |
| 386,272 | 7/1888 | Sibley | 66/10 |
| 393,189 | 11/1888 | Stowe | 66/10 |
| 1,998,473 | 4/1935 | Welch et al. | 66/8 |
| 2,004,260 | 6/1935 | Welch et al. | 66/81 X |
| 2,541,192 | 2/1951 | Blake | 66/132 R |
| 2,825,016 | 2/1958 | Bailey | 66/132 R X |
| 3,303,671 | 2/1967 | Oliver, Jr. | 66/132 R |
| 3,630,052 | 12/1971 | Fertig et al. | 66/125 R X |
| 3,727,033 | 4/1973 | Bassist | 66/125 R X |
| 3,780,541 | 12/1973 | Haynes | 66/132 R X |
| 3,812,691 | 5/1974 | Engelfried | 66/219 |
| 3,818,725 | 6/1974 | Sakuragawa et al. | 66/10 X |
| 3,858,416 | 1/1975 | White et al. | 66/132 R |
| 3,901,050 | 8/1975 | Schur et al. | 66/81 X |
| 4,194,375 | 3/1980 | Marchisio | 66/146 X |
| 4,231,234 | 11/1980 | Schmid | 66/27 |
| 4,531,385 | 7/1985 | Jacobsson | 66/144 X |
| 4,691,535 | 9/1987 | Cottenceau et al. | 66/144 |
| 4,920,767 | 5/1990 | Plath | 66/13 |

FOREIGN PATENT DOCUMENTS

| | | | |
|---|---|---|---|
| 914675 | 3/1982 | U.S.S.R. | 28/194 |
| 6526 | of 1887 | United Kingdom | 28/190 |
| 526337 | 9/1940 | United Kingdom . | |
| 1120227 | 7/1968 | United Kingdom . | |
| 1384522 | 2/1975 | United Kingdom . | |
| 1391202 | 4/1975 | United Kingdom . | |
| 1414474 | 11/1975 | United Kingdom . | |
| 1429605 | 3/1976 | United Kingdom . | |

*Primary Examiner*—Wm. Carter Reynolds
*Attorney, Agent, or Firm*—Michael J. Striker

[57] ABSTRACT

A thread supply device for multi-system circular knitting machines has at least one warp beam accommodated rotatablhy in a receiving frame. On the warp beam are wound the threads associated with the individual knitting systems in the form of adjacent thread winding areas with equal axial lengths and equal diameters. The warp beam is connected with a drive and driven thereby in such a way that it always delivers to the knitting systems the average thread quantitites consumed thereby during operation of the circular knitting machine irrespective of the momentary diameters of the thread winding areas.

16 Claims, 7 Drawing Sheets

THREAD SUPPLY DEVICE FOR A CIRCULAR KNITTING MACHINE

This application is a continuation of application Ser. No. 07/231,509, filed Aug. 12, 1988 now abandoned.

The invention relates to a thread supply device for a circular knitting machine, which comprises a needle carrier and a cam ring, a drive for producing a relative rotary motion between the needle carrier and the cam ring and a plurality of knitting systems which consume the same thread quantities per revolution of the circular knitting machine, with receiving means for replaceable accommodation of thread supply sources associated with the individual knitting systems and with thread guide means guiding the threads on predetermined thread paths from the thread supply sources to the knitting systems.

It has always been usual with circular weft knitting machines to arrange a bobbin frame on the machine frame of the circular knitting machine above the rib disk or the needle cylinder, said bobbin frame comprising the stub arbor for the individual yarn bobbins from which the individual knitting points or systems of the circular knitting machine are supplied with yarn. Apart from the large space requirement of this bobbin frame in circular knitting machines with a large number of systems, changes of bobbin and the tying-in of new yarn bobbins necessitated thereby are laborious and relatively time-consuming. It is also troublesome that as a rule the yarn bobbins run out at different times and thus the need to change one of the yarn bobbins is almost constant.

Comparable problems are to be found with the use of bobbin racks which are mounted to the side of the knitting machine. However, such bobbin racks have the advantage that they are somewhat more user-friendly.

Especially with multi-system, fast-running, high-performance circular knitting machines, as are increasingly used today, for example, for producing plain fabric, the time and labour required to change bobbins are crucial.

Although suggestions have already been made for automatically knotting-on or changing yarn bobbins in bobbin racks by using automatic knotting apparatuses or robots, up to now no practical solution has been made known which would substantially have simplified the problems connected with changing bobbins in a circular knitting machine.

The problem on which the invention is based is therefore that of providing a remedy to this problem and so improving the above-described thread supply device that it ensures simple, reliable thread supply of the knitting systems of the circular weft knitting machine, opens up the way to automation of the processes connected with thread supply and diminishes the difficulties hitherto connected with changing bobbins.

This problem is solved by the thread supply device comprising a receiving frame with at least one warp beam accommodated rotatably therein, on which warp beam are wound the threads associated with the individual knitting systems and in the form of adjacent thread winding areas, which areas have the same axial lengths and the same diameters, and by the warp beam being connected with drive means in such a way that the thread winding areas, irrespective of their diameters, always supply to the knitting systems associated with them the average thread quantities consumed thereby per revolution of the circular knitting machine.

The invention brings with it a large number of advantages. The warp beam requires substantially less space than single bobbins. The coaxially adjacent thread winding areas allocated to the individual knitting systems ensure a clearly laid-out arrangement of the individual thread supply sources and problem-free thread discharge unlike single bobbins. Since the threads are drawn from the warp beam at right angles to the warp beam axis and at a tangent, no plucking and no thread breakages caused thereby can occur. Furthermore, the number of errors caused by the yarn itself is substantially lower, as the yarn located on the warp beam has already been tested by the warping process. Moreover, the thread paths are short, since the threads only need to be taken via thread break monitors, such that all threads can also run in tubes and be protected thereby. Since the warp beam is rotated at a circumferential speed corresponding to thread consumption, the thread supply devices (feeders) otherwise needed for each individual thread are superfluous. The warp beam can easily be arranged under an optionally air-conditioned protective cover for protection against fibre fly, such that the problems arising from the known fluffing of the single bobbins do not occur. Finally, the above-mentioned clearly laid-out, adjacent arrangement of the thread winding areas offers the guarantee that the risk of confusing individual threads during tying-in is reduced to a minimum, without an excessive need for attentiveness on the part of the operating personnel.

As a rule, the need to provide individual thread brakes in the thread paths is also dispensed with, since so-called jumping threads, as occur during overhead discharge of certain yarns from individual spools, cannot arise. In addition, the tangential thread discharge from the warp beam exhibits the advantage that no additional twist is introduced into the threads, as is necessarily the case with overhead discharge.

The warping of the warp beam for mounting of the individual thread winding areas can be effected fully automatically. By appropriate warping of the warp beam all patterns are possible, as are plating, processing of fleecy fabric, manufacture of binding fabric, linings and stripes etc.

In addition to the known use in weaving technology, warp beams can also be used in certain circular working and circular knitting machines (DE-PS 1 250 956, DE-OS 17 60 613 and DE-OS 23 16 642). For these purposes, however, conditions are quite different and cannot be compared with the conditions prevailing in a high-performance circular knitting machine. Furthermore, in the known systems, the warp beam is not driven as a rule, which is impossible with very quick running circular knitting machines because of the low thread count.

The threads may be warped onto the warp beam (which can be re-used after the threads are used up) in the manner indicated by means of the warping machines known from weaving technology.

The drawings show exemplary embodiments of the invention.

Figure 1:
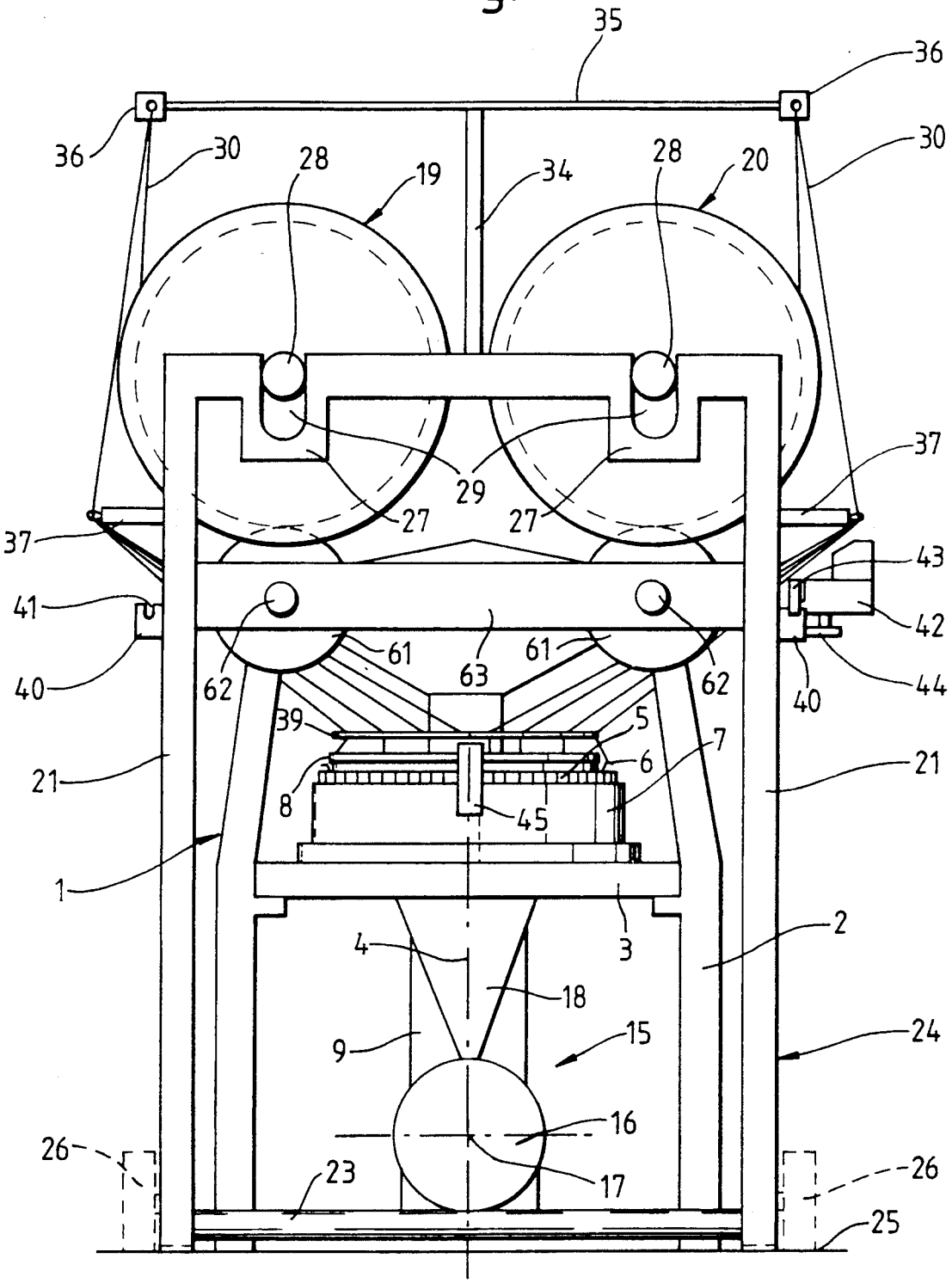
FIG. 1 shows a diagrammatic side view of a thread supply device according to the invention associated with a circular knitting machine.
Figure 2:
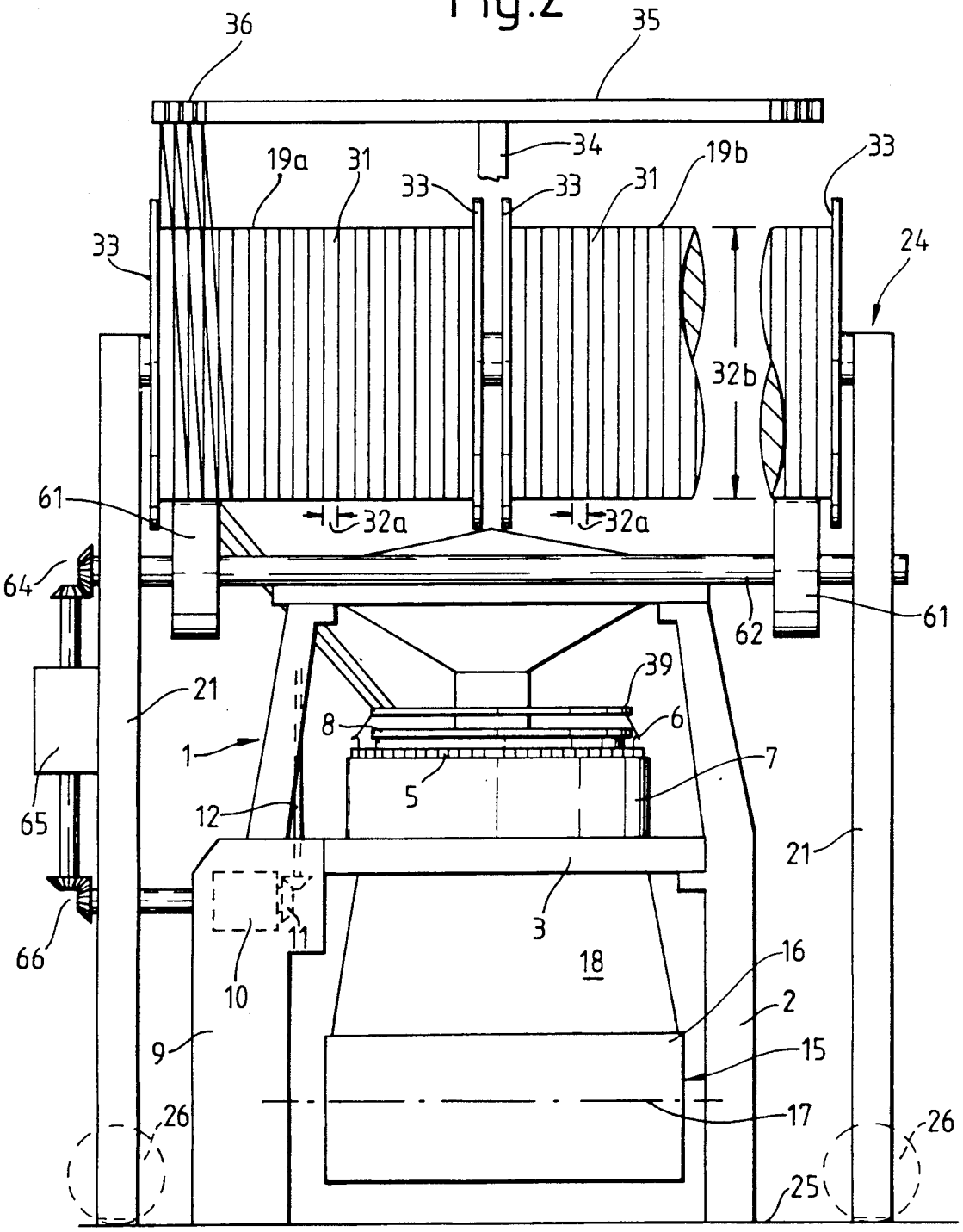
FIG. 2 shows the arrangement of FIG. 1 in a different side view.

The thread supply device shown in FIGS. 1 and 2 serves to supply thread to a circular knitting machine 1, of which only the essential elements are shown diagrammatically in the two Figures.

The circular weft knitting machine 1 comprises a stationary machine frame 2, which is provided with a frame ring 3, on which there is mounted rotatably a preferably rotatable needle cylinder 5, for example rotating around a vertical axis 4, said needle cylinder 5 being equipped with needles indicated diagrammatically at 6. Control of the needles 6 is effected in a known way by cams (not shown in any more detail) which are arranged in a cam ring 7 arranged stationarily on the frame ring 3. The rib disk, likewise shown only diagrammatically, with the associated rib cam is designated 8. The cam ring 7 and the rib cam form with their cam parts in a known way a plurality of knitting systems distributed at the circumference of the needle cylinder 5 or the rib disk.

Driving of the needle cylinder 5 and the rib disk at 8 is effected centrally via a positive transmission by a drive unit 9, which contains a drive 10, e.g. an electric drive motor. The drive 10 is coupled with a known transmission (which is not shown in any more detail) via a bevel-wheel train indicated at 11 and a drive shaft 12, said known transmission being in turn in drive connection with the needle cylinder 5 and the rib disk.

Below the needle cylinder 5 there is arranged to rotate therewith a fabric draw-off of a known construction indicated only diagrammatically in outline and of which the winding roller receiving the fabric bales 16 is driven rotatingly around a horizontal axis of rotation 17, the fabric tube coming from the needle cylinder 5 being designated 18.

The yarn supply of the circular knitting machine 1 according to FIGS. 1 and 2 is effected by a central thread supply device from warp beams 19, 20. The thread supply device comprises a receiving frame 24 consisting of vertical and horizontal frame parts 21, 22, 23 and of welded construction, said frame 24 extending with its horizontal frame parts 22 beyond the circular knitting machine 1 in the manner shown in FIGS. 1 and 2. To this end, the receiving frame 24 is constructed substantially in the manner of a portal. It is mounted with its vertical, column-type frame parts 21 on the floor 25, however, the arrangement can also be such that the receiving frame 24 can be displaced on the floor 25. In this embodiment, the receiving frame 24 is provided with castors 26, which are indicated in FIGS. 1 and 2 by broken lines. Thus, for example, a second receiving frame 24 can be brought up to the circular knitting machine from the side and to change the warp beam the new full warp beam can be inserted into bearing parts 27 at a separate preparation point, for example by means of a fork-lift truck. The thus prepared receiving frame 24 can be exchanged after tying-in of the threads for the frame containing the empty warp beam.

To simplify handling, the warp beam 19 or 20 can also be assembled from two partial warp beams, as shown at 19*a* and 19*b* in FIG. 2. Each partial warp beam 19*a*, 19*b* comprises a bobbin with flanges 33, and both bobbins are mounted unrotatably on a common shaft, which in turn carries the bearing pins 28.

The warp beams 19, 20 or partial warp beams 19*a*, 19*b* are warped throughout over their whole length. However, it is also possible, especially with difficult yarns, to provide thin walls in the manner of the flanges 33 between the individual thread winding areas 31, and thereby to separate the thread winding areas 31 from each other axially.

On the two horizontal frame parts 22, which run parallel to each other at a distance and are arranged at a distance above the circular knitting machine 1, there are provided the bearing parts 27 lying opposite each other in pairs and in which the two warp beams 19, 20 are accommodated rotatably with the bearing pins 28. The bearing parts 27 comprise bearing slits 29 running parallel to the vertical axis 4 and open at the top 29, in which the bearing pins 28 are accommodated not only rotatably but also displaceably with a sliding fit. Moreover, the warp beams 19, 20 are mounted in parallel and horizontal alignment.

The thread supply device serves to supply each of the individual knitting systems with threads 30. To this end, the warp beams 19, 20 are warped in such a manner that the threads 30 are each wound in their own adjacent thread winding areas 31 associated individually with each thread 30. The thread winding areas 31 located on one warp beam 19, 20 each have the same axial length 32*a* and the same diameter 32*b*, the length 32*a* resulting from the warp beam length available for winding the threads 30 and the number of knitting systems on the circular knitting machine 1. Since all the thread winding areas 31 comprise the same axial length 32*a* and the same diameter 32*b*, the same thread stock quantity is allocated to all the knitting systems on the circular knitting machine 1. On condition that, during operation of the circular knitting machine 1, knitting systems which obtain their threads 30 from the same warp beam 19 or 20 have the same thread consumption, the warp beam empties at the same rate, such that when it is changed no different amounts of thread remain thereon.

To drive the warp beams 19, 20 friction rolls 61 are provided thereunder with axes running parallel to the warp beam axes, on which rolls 61 rest the peripheries of the warp beams 19, 20. The friction rolls 61 are fastened to a shaft 62, which is accommodated rotatably in additional frame parts 63 mounted under the warp beams 19, 20. An end of the shaft 62 arranged outside the machine frame 2 is connected by means of a bevel-wheel train 64 with the output shaft of a preferably steplessly adjustable transmission 65, the drive shaft of which is connected by means of another bevel-wheel train 66 with the drive shaft of the drive 10 of the circular knitting machine 1.

Because of the use of a positive gear transmission ratio there exists a rigid synchronicity between the drive 10, the needle cylinder 5 and the drive means (61 to 66) for the warp beams 19 and 20. As a result thereof, the warp beams 19, 20 are driven at their circumferences, when the circular knitting machine 1 is in operation, in such a manner that the thread quantities supplied by the thread winding areas 31 per needle cylinder revolution depend only on the preselected transmission ratio. This transmission ratio can be adjusted and altered as desired by means of the transmission 65. This provides the advantage that after such an adjustment of the transmission ratio the thread quantities per needle cylinder revolution delivered by the thread winding areas 31 per needle cylinder revolution remain constant irrespective of how great the momentary winding diameter of the warp beam 19, 20 is or the momentary rotational speed of the needle cylinder 5. If the winding diameter of the warp beam 19, 20 diminishes gradually, then the bearing pins 28 only move further downwards in the bearing slits, without the thread quantities delivered per needle cylinder revolution altering. At the same time it is an obvious prerequisite that the bearing slits 29 have a depth such that the warp beams 19, 20 rest on the circumference of the friction rolls 61 even in the virtually empty state. If the rotational speed of the needle cylinder 5 changes, then only the rotational speeds of the friction rolls 61 alter correspondingly, not the thread quantities delivered per needle cylinder revolution, since the relationship between the rotational speeds of the friction rolls 61 and the needle cylinder 5 remain unchanged.

Instead of being related to one needle cylinder revolution the quantities of thread delivered by the thread winding areas 31 could also be related to a multiple or a fraction thereof, e.g. even a needle division. However, this does not in any way alter the fact that the peripheral speed of the warp beam 19, 20 is constantly conformed by means of the transmission 65 to those thread quantities which are consumed by the associated knitting systems on average per needle cylinder revolution. Since such an adaptation has the same effect on all of the thread winding areas 31 located on one warp beam 19, 20, it results automatically in an increase or reduction in the thread quantities at all associated knitting systems. Therefore, under all operating conditions the thread quantities required or consumed by the associated knitting systems are supplied thereto.

In the production of plain white or single-colour fabric all the thread winding areas 31 contain similar threads 30. To produce multi-colour fabrics the warp beam 19, 20 can, however, also be appropriately warped with many colours. It is correspondingly possible to use several warp beams 19, 20 which are each provided with threads of a different colour or property.

A thread guide frame 34 is mounted on the horizontal frame parts 22, which guide frame 34 carries thread breakage monitors 36 arranged on horizontal frame parts 35, said monitors 36 having deviating eyes through which the threads 30 coming from the individual thread winding areas 31 are held at uniform distances from each other and diverted by approximately 180°. From the thread breakage monitors (stop means) 36 the threads 30 of each warp beam 19 or 20 run to an associated thread warp separating rail 37, which is fastened to the corresponding vertical frame parts 21 in horizontal alignment. Each of the two thread warp separating rails 37 carries a thread guide comb (not shown in any more detail) with grooves, by means of which the threads are held in parallel alignment with each other and at uniform separation from each other.

On the path of the threads 30 a circular thread deviating ring 39 coaxial with the vertical axis 4 is arranged downstream of the two thread warp separating rails 37 and is fastened to the upper part of the machine. From the thread deviating ring 39 the threads 30 pass in the usual way to the evenly distributed knitting systems, thread guide members (not shown in any more detail) in the form of deviating eyes etc. ensuring the correct thread path.

To simplify and speed up warp beam exchange, below each thread warp separating rail 37 a horizontal, annularly closed guide rail 40 is preferably screwed to the two corresponding vertical frame members 21, said guide rail 40 comprising a longitudinally running guide groove 41 and forming a guide device for a diagrammatically indicated tying-in unit 42 which serves to tie in the threads of a replacement warp beam, e.g. the warp beam 20, to the still stretched threads of the emptying warp beam, e.g. the warp beam 19. The tying-in unit 42 is hung with a guide roll 43 in the guide groove 41 and supported laterally against the guide rail 40 by a drive roller 44, which can be driven according to the program by a drive motor (not shown in any more detail) of the tying-in unit 42, said drive motor preferably being constructed as a stepping motor. The stepping motor engages with a pinion in corresponding teeth on the guide rail 40. In this way, automation of the whole tying-in process is made possible. Alternatively, tying-in can be effected manually, however.

By appropriate driving of the drive roller 44 the tying-in unit 42 can have a step-wise longitudinal motion along the guide rail 40 in such a way that the tying-in unit 42 moves past the threads 30 held at even distances by the separating comb from thread to thread or from thread group to thread group and ties them in individually.

Alternatively, the guide rail 40 could also be arranged in the manner of a coaxial guide ring directly on the machine frame 2 of the circular knitting machine 1 in the vicinity of the arriving thread warp.

As a rule, the replacement warp beam has its own drive means, which allow switching from the empty to the full replacement warp beam after the warp beam drive has been tied in. Since with such a warp beam all the threads start at the same time and all the threads of the warp beam also correspondingly run out at the same time, the conditions for the use of automatic thread tying-in means are particularly favourable. Automatically operating thread tying-in apparatuses are known. They are used extensively for example in spinning technology with modern multi-spindle machines.

It is basically possible to install such thread tying-in means firmly on the circular knitting machine 1 or on the receiving frame 24 of the warp beam; however one tying-in apparatus can also be used for several machines. In each case it is possible in this way to keep short the idle times for warp beam replacement and the tying-in process. The idle times can also be used for cleaning the circular knitting machine and removing the finished fabric bales 16.

In practice, it can be provided that half of the knitting systems are supplied by the warp beam 19 and the other half of the knitting systems by the warp beam 20. However, it is also possible to distribute thread supply over more than two warp beams, which may also optionally be arranged distributed around the knitting machine 2. Irrespective of the number of warp beams in use, however, even with this manner of operation all the warp beams empty at the same time, insofar as all the knitting systems have the same rate of thread consumption, such that they can also be replaced at the same time with new warp beams. The new warp beams brought into a position next to the receiving frame 24, for example in an appropriate replacement frame, are tied in by means of the tying-in units 42 and then inserted in the bearing parts 27, the circular knitting machine then being once again ready for operation.

With an alternative, preferred method of operation, which in particular allows continuous production, all the knitting systems are supplied from one warp beam 19 or 20, while the other warp beam 20 or 19 serves as a replacement warp beam. When the warp beam currently in operation empties, the replacement warp beam is tied in and then brought into operation. Then the empty warp beam can be exchanged, without it being necessary to stop the circular knitting machine 1.

With "alternating operation" without tie-in, in which the circular knitting machine 1 always has two warp beams 19, 20 associated with it, one of which is ready after the change has been effected, thread changing apparatuses (striping units) are appropriately associated with the knitting systems of the circular knitting machine 1, one of which apparatuses is indicated diagrammatically in FIG. 1 by 45. Such thread changing apparatuses are known and are described, for example, in the book "Technologie der Rundstrickerei, die Rundrandermaschinen a, die Kleinrundrandermaschinen" by Albert Diebler, Konradin-Verlag R. Kohlhammer. They comprise, for example, two feed finger, with which are associated thread cutting devices and thread clamps. On receipt of a corresponding control command, thread exchange is effected in such a manner that the one thread fed by a feed finger from one warp beam is inactivated, clamped fast in the thread clamp and cut off, while the other feed finger initiates feeding of thread, from the other warp beam.

Use of these thread changing devices allows the circular knitting machine to operate continuously over long operational periods without interruption.

Figure 3:
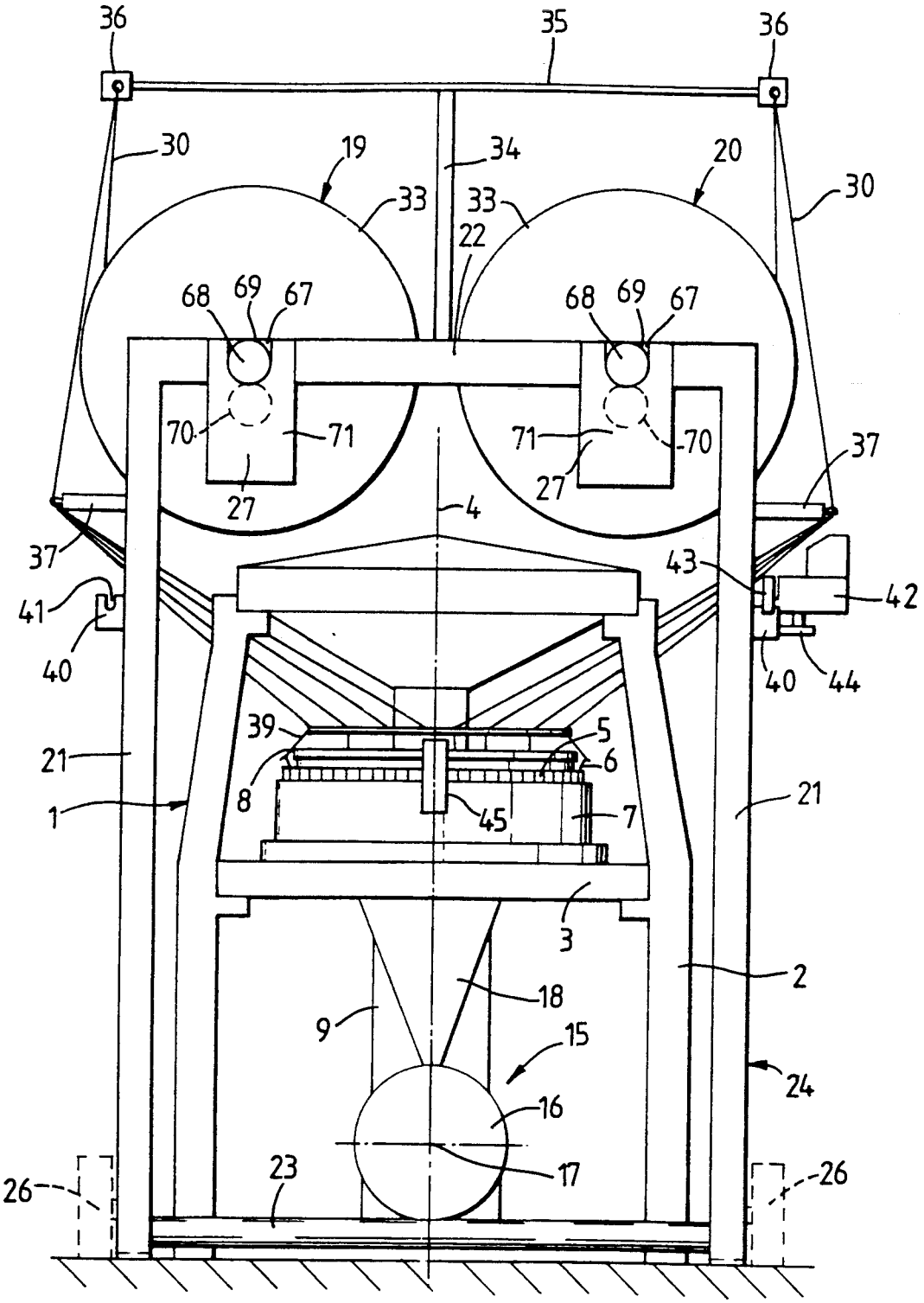
FIGS. 3 and 4 show a second embodiment of the thread supply device in views corrresponding to FIGS. 1 and 2.
Figure 4:
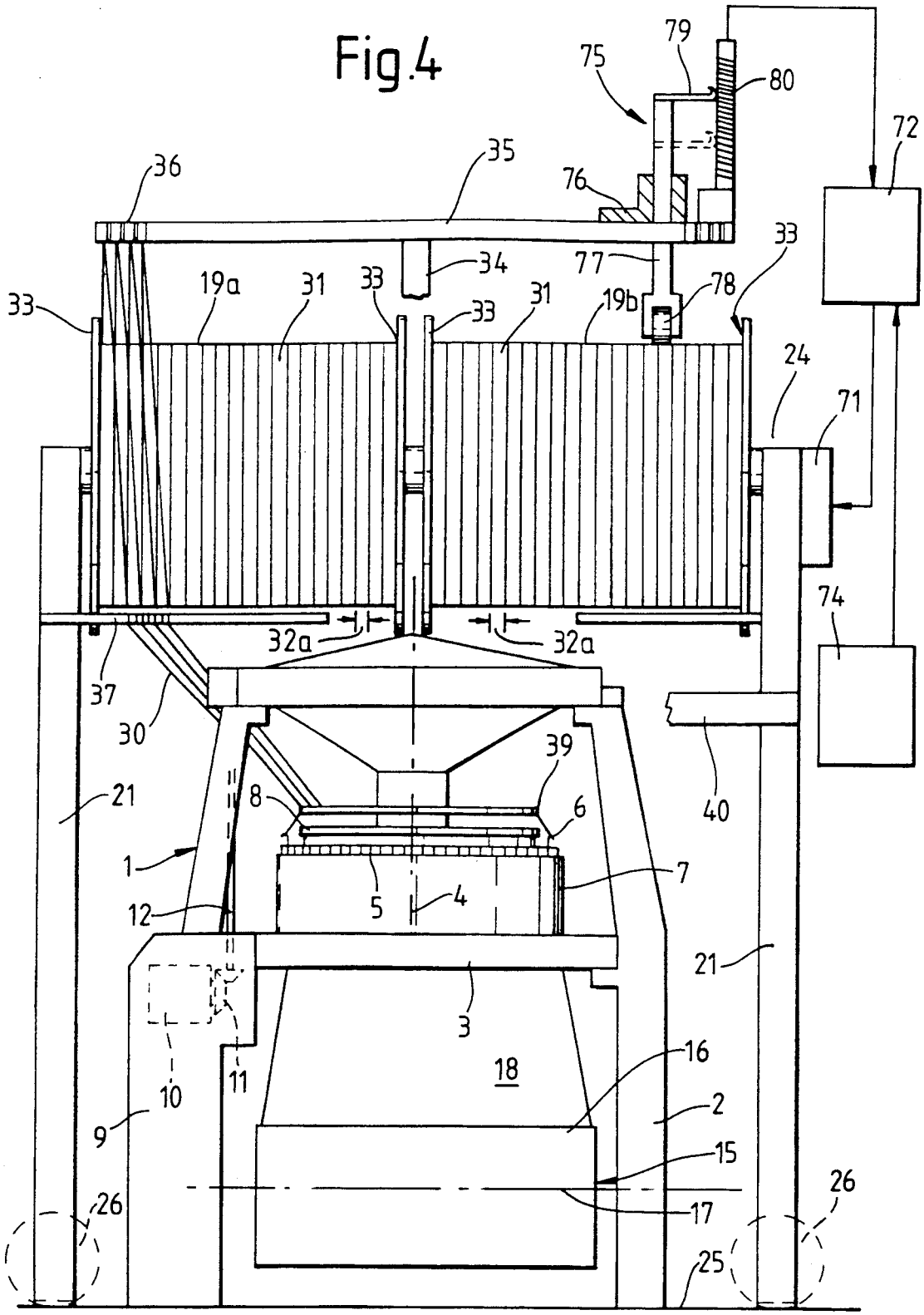

The thread supply device shown in FIGS. 3 and 4 differs from the embodiment according to FIGS. 1 and 2 only in the drive means for the warp beams 19 and 20. Thus, the same reference numerals are used for all parts remaining the same in FIGS. 3 and 4 as in FIGS. 1 and 2.

According to FIGS. 3 and 4, the bearing parts 27 comprise bearing slits 67 open at the top, which form bearing bushes open at the top, on which rest rotatably the bearing pins 68 of the warp beams 19, 20. The bearing pins 68 each carry a pinion 69, which is in engagement with a drive gear 70, which is attached to the output shaft of a drive unit 71 fastened to one of the frame parts 22. At the same time, a separate drive unit 71 is associated with each warp beam 19, 20.

Since the drive of the warp beams 19, 20, in contrast to FIGS. 1 and 2, is effected by means of the warp beam axes, the thread quantities delivered per needle cylinder revolution at a constant speed of rotation of the drive units 71 should depend on the momentary winding diameter of the warp beams 19, 20 or the thread winding areas 31 and therefore be smaller, the smaller this winding diameter. However, since the thread quantities delivered by the thread winding areas 31 per needle cylinder revolution at a constant needle cylinder speed of rotation and thus with constant thread consumption must likewise remain constant, a control circuit is additionally provided for this type of drive means (68 to 71) to keep constant the quantities of thread delivered. This contains a regulator 72 (FIG. 4), which generates a signal at its output, which controls the drive unit 71 in such a manner that the peripheral speed of the warp beam 19, 20 is increased by the amount that the winding diameter decreases. At the same time, an input of the regulator 72 can be connected with a reference element 74, by means of which different thread quantities, e.g. preselected thread lengths per revolution of the needle cylinder 5, can be individually or steplessly preselected.

To obtain a measurement for the momentary thread quantities delivered by the thread winding areas 31, another input of the regulator 72 is connected with an actual value element 75, which measures the momentary winding diameter of the warp beam 19, 20. According to FIG. 4 this actual value element 75 comprises a mount 76 fastened to the frame part 35, in which mount a bar 77 is guided displaceably, which bar is supported with a castor 78 accommodated rotatably at its one end on the circumference of the warp beam 19, 20. As a result thereof, an arm 79 arranged at right angles to the bar is displaced, which arm 79 is shown in FIG. 4 with solid lines in a position corresponding to the original winding diameter and with broken lines in a position which results from the decrease in the winding diameter by the measured amount. The respective position of the arm 79 is sensed by means of a sensor 80 and supplied to the regulator 72 in the form of an electric signal. This compares the signals from the reference and actual value elements 74, 75 and generates therefrom the control signal for the drive unit 71 appearing at its output 73.

In order to ensure in this case that even with different speeds of rotation of the needle cylinder 5 thread quantities are always delivered which correspond to the thread consumption per needle cylinder revolution, the drive unit 71 is constructed, for example, as differential gearing, on the output shaft of which the drive gear 70 is fastened and the one input of which is synchronized by the bevel gear 64 according to FIGS. 1, 2 with the drive 10 for the needle cylinder 5. Another input of the differential gearing is, on the other hand, connected with the output shaft of a servo motor, the speed of rotation of which is controlled by the regulator 72. Therefore, the output shaft of the differential gearing is always driven at an overlapping speed of rotation, which is composed of a component taking into account the momentary speed of rotation of the needle cylinder 5 and a component taking into account the momentary winding diameter of the warp beam 19, 20.

Figure 5:
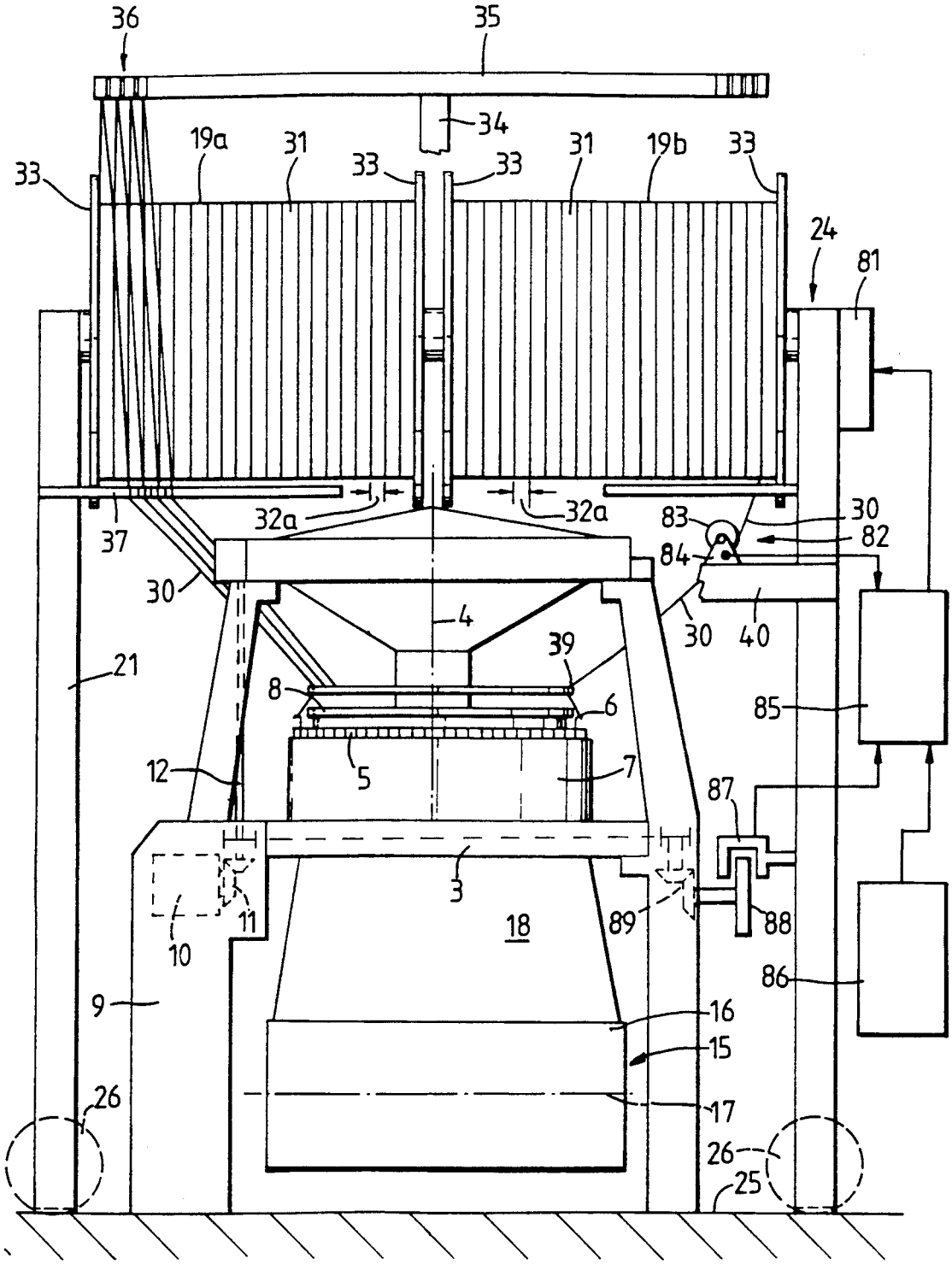
FIGS. 5 and 6 show two further embodiments of the thread supply device, each from a viewpoint corresponding to FIG. 2.

In the embodiment according to FIG. 5 parts remaining the same are allocated the same reference numerals as in FIGS. 3 and 4, since the thread supply device according to FIG. 5 differs from the thread supply device according to FIGS. 3 and 4 only in the different type of control. The drive of the partial warp beams 19*a*, 19*b* is effected in this embodiment in accordance with FIGS. 3 and 4 via the warp beam axes with the aid of a drive unit 81. Actual value measurement is here effected by thread length or thread consumption measurement. To this end, an actual value element 82 fastened for example to the guide rail 40 comprises a rotatable measuring roll 83 arranged in the thread path of any thread 30 and encircled by the thread 30, said measuring roll 83 rotating at a speed of rotation which depends on the running speed of the thread transported thereby and thus on the thread quantity supplied at that moment. The measuring roll 83 has on its circumference marks, e.g. holes, which are sensed by a for example opto-electronic sensor 84 and converted into electrical signals, the repetition frequency of which is related to the momentary thread consumption. These signals are supplied to a regulator 85, converted thereby into an actual value signal indicating the thread quantity per cylinder revolution and compared with the reference value signals of a reference element 86, which may correspond to the reference element 74 according to FIGS. 3, 4.

Furthermore, the electric clock signals of a sensor 87 are supplied to the regulator 85, which is fastened, for example, to one of the frame parts 21 and senses the marks provided at constant distances around the circumference of a pulse generator 88, which marks may consist of slits or holes, which are sensed e.g. optically by the sensor 87 and converted into the electric clock signals. The pulse generator 88 consists of a disk accommodated rotatably in the machine frame 2, which disk is connected by a bevel gear 89 with a gear rim located at the circumference of the needle cylinder 5 and therefore rotates synchronously with the needle cylinder 5. The clock signals delivered by the sensor therefore have a repetition frequency which is in fixed relationship with the momentary speed of rotation of the needle cylinder 5.

In the regulator 85 the signals of the sensor 84 are compared with the clock signals of the sensor 87 in such a way that a number of signals from the sensor 87 set at the reference element 86 must appear per needle cylinder revolution or a fraction thereof, e.g. per revolution of the pulse generator 88. If this number is too small, e.g. as a result of a reduction in the winding diameters of the partial warp beams 19*a* and 19*b*, then a control signal is generated at the output of the regulator 85 which signal loads the drive unit 81 in such a way that the partial warp beam 19*a,b* is rotated somewhat faster. If the number of signals generated by the sensor 87 per revolution of the pulse generator 88 is too great, on the other hand, then an adjustment is made in the opposite direction. Since with this regulation, with which the thread consumption by the knitting systems is the control quantity, similar conditions arise when the needle cylinder 5 is rotated more quickly or more slowly with respect to the momentary speed of rotation of the partial warp beams 19*a,b*, the above-described electrical synchronisation between the two suffices, i.e. additional mechanical synchronization is unnecessary.

Figure 6:
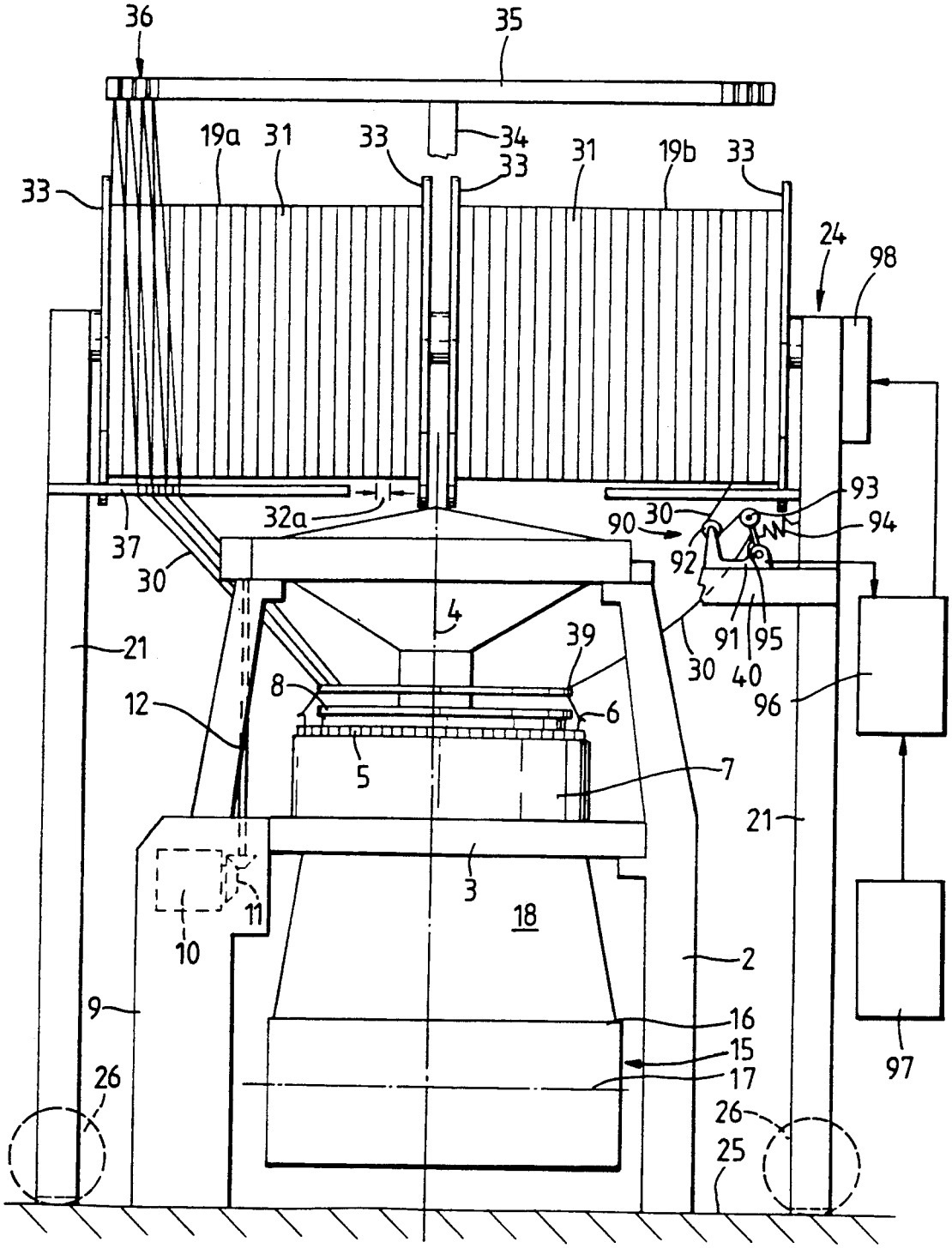

The embodiment according to FIG. 6 corresponds to the embodiment according to FIG. 5 except for another variation in regulation, which is effected here using the thread tension as the control quantity. An actual value element 90 fastened for example to the guide rail 40 contains a mount 91 for the rotatable accommodation of two measuring rolls 92 and 93, which are encircled by any of the threads 30. In this way, the thread 30 is firstly diverted by the roll 92 accommodated rigidly in the mount 91 and then by the roll 93 by approximately 180° each time. The roll 93 is mounted swivellably on the mount 91 by means of a swivellable arm 95 influenced by the spring 94, such that the respective swivel position of the arm 95 or the deflection of the spring 94 is a gauge for the momentary thread tension. The momentary position of the arm 95 or the deflection of the spring 94 is registered by means of a sensor (not shown) which supplies corresponding actual value signals to a regulator 96. This compares the actual value signals with the signals of a reference element 97 corresponding to the reference element 64 (FIGS. 3, 4) and generates a control signal at its output for a drive unit 98 corresponding to the drive unit 81 (FIG. 5), which unit 98 consists, for example, of an electric drive motor with an electrically controllable speed of rotation.

The measuring roll 93 or the sensor associated therewith enable measurement of the thread tension or the tensile force exerted on the thread. If these are increased or decreased when the momentary speed of rotation of the needle cylinder 5 rises or drops or the momentary speed of rotation of the partial warp beams 19*a,b* becomes smaller or greater, the speed of rotation of the drive unit 98 is automatically and correspondingly increased or decreased by the regulator 96, until the thread quantity delivered per needle cylinder revolution corresponds again to the predetermined reference value. The same is true if the thread quantity delivered per needle cylinder revolution or the like decreases as a result of a decrease in the winding diameter of the partial warp beams 19*a,b* and as a result thereof the tensile force on the thread is increased. An additional synchronisation of the drive 10 with the drive means for the partial warp beams 19*a,b* is not necessary.

Since all the threads 30 are subject to the same conditions, the regulators 74, 85 and 96 according to FIGS. 3 to 6 need in principle only monitor the conditions at one of the threads coming from any warp beam or at one of the thread winding areas, although naturally several regulators per warp beam can be provided. Although in FIGS. 3 to 6 only a single regulating device for one of the warp beams 19, 20 is shown, it goes without saying that all the warp beams 19,20 present have their own corresponding regulating device associated with them.

Figure 7:
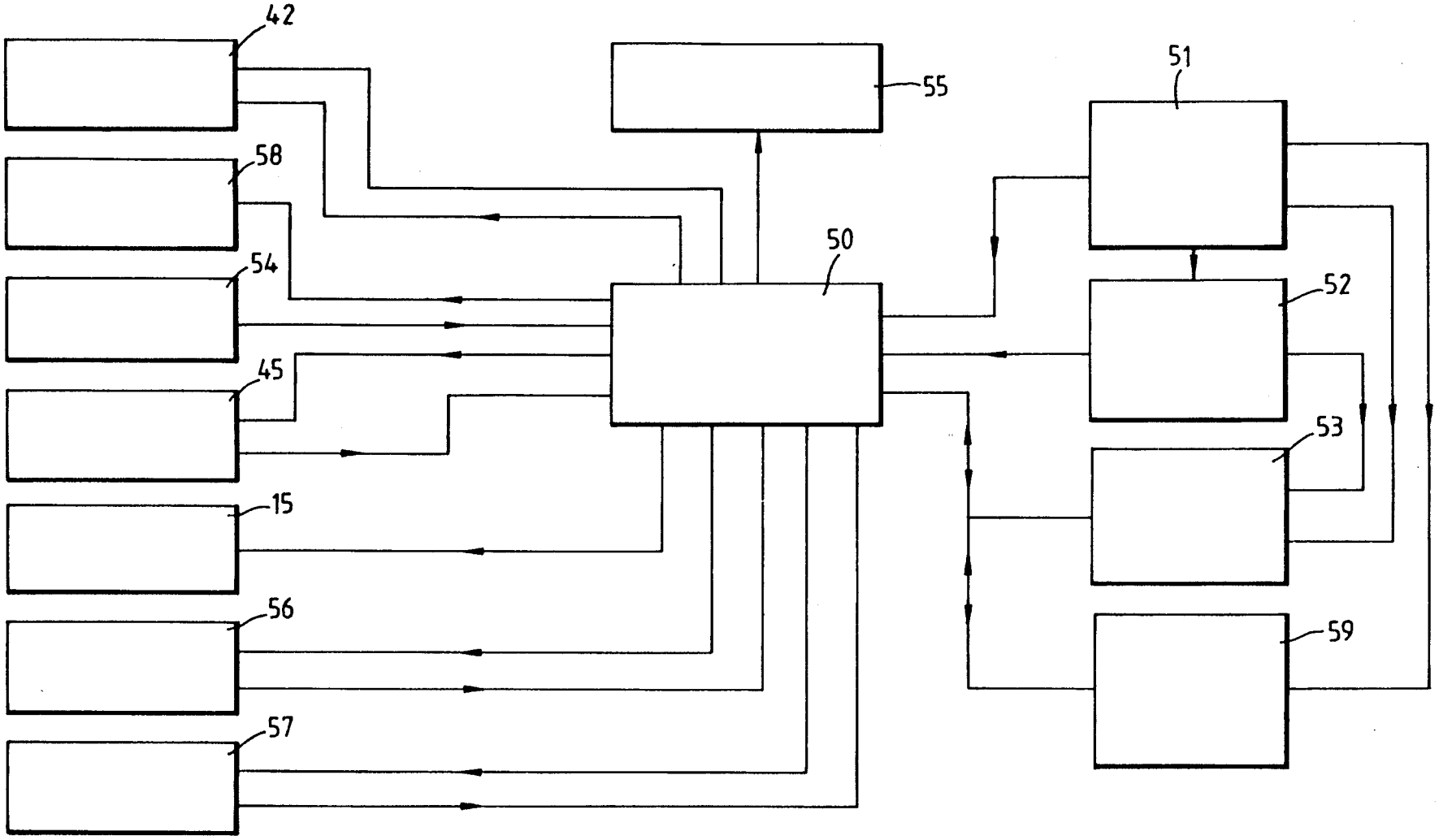
FIG. 7 shows a schematic block diagram of an electronic central control for the thread supply devices and the circular knitting machine according to FIGS. 1 to 6.

Because of the thread supply device according to the invention, the production sequence of the circular knitting machine can be controlled fully automatically according to the program by a central control unit 50, as is illustrated diagrammatically in FIG. 7.

The central control unit 50 receives information according to the program from a program element 52 supplied by a power supply unit 51, which information is shown for monitoring on a data display unit 53, which can at the same time be questioned on the respective operational position or asked for data characterizing this. An element 54 is provided on the circular knitting machine to monitor the rotary motion of the needle cylinder 5, which element 54 delivers signals characterizing the speed of rotation of the circular knitting machine to the control unit 50.

From these signals and the information received from the program element 52 the control unit 50 generates control commands according to the program, by means of which first of all the different drive means shown by a block 55 for the warp beams 19, 20 or the needle cylinder and/or the rib disk are controlled.

Furthermore, the control unit 50 delivers control commands according to the program to the tying-in units 42, to the thread changing devices 45, to the drive device of the winding roll of the fabric take-off 15, to an automatic cutting device 56 for the fabric tube 18 and to a fabric bale ejection device 57 automatically ejecting the fabric bale after the fabric tube 18 has been cut. All of these units are shown in simplified manner in FIG. 7 by blocks. At the same time, the control unit 50 can be selectively connected with all the units or with certain selected units.

In order to be able to change the fabric quality while the circular knitting machine 1 is running, said machine can be provided with a central adjusting device 58 for the needle cams, by means of which device the knocking-over depth of the needles 6 can be influenced. Adjustment of the cam parts can be effected by stepping motors, which are appropriately controlled by the control unit 50. If adjustment of the cam parts is undertaken when the machine is running, however, it must be ensured by control of the block 55 that the warp beams' rotational speed is altered, said alteration being conformed to the altered thread consumption of the knitting systems owing to the partial cam adjustment. This can, for example, be effected in that the control unit supplies signals to the reference elements 74, 86, 97 or the transmission 65 which are related to the momentary position of the cam parts.

Finally, a monitoring unit 59 for the circular knitting machine is also provided which delivers information characterizing the operational state to the control unit 50 and to which, for example, the thread breakage monitors 36 are connected. If unusual operational states arise the monitoring device 59 causes, by way of the control unit 50, immediate stopping of the circular knitting machine 1 and the drive of the warp beams 19, 20. It can, however, also deliver warning signals etc. or commands to alter the operational state.

A typical example for the manner of operation of a circular knitting machine controlled in this way is as follows.

After an automatic starting check, monitored on the display unit 53, the circular knitting machine 1 can be started. During the starting check it is determined, for example, whether the warp beam is attached, whether the threads are drawn in, whether the tying-in units 42 are out of operation, whether the thread breakage monitor 36 is connected, whether the control unit 50 is switched on, whether the thread tensions are correct, whether the fabric take-of 15 is ready for operation, whether the thread changing devices 45 are ready for operation and whether the program in the program element is at the beginning.

When the circular knitting machine has been started it processes the thread material coming from the operational warp beam 19 or 20, it being possible for the fabric quality to be altered according to the program, if necessary while the machine is running, in that the warp beam drive means 55, the drive of the fabric take-off 15 and the machine adjusting device 57 are correspondingly influenced by the central control unit 50.

If a warp beam is empty or is nearing this state, the control unit 50 receives corresponding information from the monitoring unit 59, which causes the control unit 50 to begin warp beam replacement.

To this end, a sub-program runs comprising the following steps.

A thread drawing-off and cutting device in the tying-in unit 42 is activated. The tying-in unit 42 travels on its guide rail 40 along the thread warp of the stopped warp beam and cuts the threads 30, which are drawn off therefrom on the thread warp separating rail 37 in corresponding clamps.

Thereafter, the empty warp beam is lifted from its bearing elements 27 and replaced by a new warp beam.

Now the threads 30 are inserted, for which purpose the frame part 35 carrying the thread breakage stop means 36 can be lowered to the level of the thread warp separating rail 37, which may be effected by a separate drive which is not shown in any more detail.

Then the tying-in unit 42 again travels along the guide rail 40 over the width of the thread warp and ties the new threads 30 to the old thread ends held on the thread warp separating rail 37.

The frame part 35 carrying the thread breakage monitor 36 now travels upwards into its operating position according to FIG. 1, whereby the threads 30 are stretched.

In this way the new warp beam is tied in. At the right time the thread change devices 45 receive a corresponding control command from the central control unit 50, such that they draw off, cut and clamp the threads 30 coming from the emptying warp beam and insert the threads 30 coming from the newly tied-in warp beam. Then the empty warp beam is replaced in the above-described way.

In this way it is possible to produce a circular knitting machine with fully automatic thread exchange for the highest operating speeds and production quantities, in which disturbance-free operation over long periods is ensured under the described operating circumstances.

If no thread change devices 45 are present, warp beam replacement is effected in fundamentally the same way, except that the circular knitting machine 1 is stopped until the warp beam replacing and tying-in process is completed.

In the above-described embodiment the receiving frame 24 is mounted on the floor 25 or optionally constructed displaceably thereon. However, an alternative construction is also feasible, in which the receiving frame 24 is mounted directly on the machine frame 2 of the circular knitting machine 1 or is constructed as a part thereof.

The invention is not restricted to the above-described embodiments, which may be modified in many ways. Thus, it is possible for example to attach the thread supply device to a circular knitting machine with rotating cam ring and correspondingly rotating thread supply device instead of to a machine with rotating needle cylinder. In this case, of course, the thread quantities supplied by the warp beams must not be conformed to the thread quantities required per needle cylinder revolution or the like but rather to the thread quantities required per cam ring revolution or the like. Therefore, the claims speak generally of adaptation of the thread quantities supplied by the warp beams to the average thread quantities or the like required per revolution of the circular knitting machine. Furthermore, the invention is described using the example of a circular knitting machine whose knitting systems all have the same thread consumption, i.e. for example a single-unit machine for the production of plain fabrics (R/L fabrics) or a two-unit machine for the production of fine rib or interlock fabrics for example. However, it is also possible to provide the thread supply device on circular knitting machines which produce fabrics with woven patterns and in which the thread consumption differs from knitting system to knitting system but is constant for each knitting system with respect to one needle cylinder revolution. In this case all knitting systems with the same thread consumption may be assembled into one system group and be supplied with threads by a single warp beam, while other system groups, whose knitting systems have another thread consumption, which is likewise the same for each of them however, are associated with other warp beams. At the same time it is wholly possible to attach different warp beams to one machine, which beams deliver different thread quantities per needle cylinder revolution. Moreover, the invention is not restricted to the above-described means of mounting, driving and controlling or regulating the warp beams, since these means may be modified in many ways and/or conformed to the conditions desired in individual cases. Finally, it would be feasible to arrange the warp beams for one or more circular knitting machines in a frame located next to the machine or in a space over the machine. At the same time it is often advantageous with respect to space conditions and the lengths of the thread paths if the receiving frame comprises frame elements extending beyond the circular knitting machine, such that the warp beams come to lie in the area above the needle cylinder of the circular knitting machine. The arrangement may, however, be such that the receiving frame is arranged directly on the machine frame of the circular knitting machine and connected therewith. At the same time, the warp beams may againlie above the needle cylinder or also at the side next to the circular knitting machine and preferably surround said machine at the level of the needle cylinder or thereabove.

We claim:

1. A thread supply device for a circular weft knitting machine having a needle carrier for knitting needles, cam means forming a plurality of knitting systems along said needle carrier, and a drive for producing a continuous relative rotary motion between the needle carrier and the cam means for moving said needles past said systems, said needles receiving threads at said systems for knitting purposes such that the same average quantities of thread are consumed at said systems during said relative rotary motion; a receiving frame; at least one warp beam rotatably mounted in said receiving frame; a plurality of adjacent thread winding areas provided on said warp beam, said thread winding areas having the same axial length and the same diameters and on each thread winding area being wound one of said threads, each thread being associated with one of said systems; thread guide means for guiding said threads from said thread winding areas on predetermined thread paths to said associated systems; and drive means, said drive means having drive wheel means coupled to said warp beam to positively drive the latter in such a way that the thread winding areas, irrespective of their momentary diameters, always supply to said systems the average thread quantities consumed thereby.

2. A thread supply device according to claim 1, wherein the warp beam is driven at its periphery, the drive wheel means comprises at least one friction roll accommodated rotatably in the receiving frame said drive means further having a drive gearing, said drive gearing being connected with said drive wheel means and being synchronized with the drive of the circular weft knitting machine, and said roll rests against the periphery of at least one of the thread winding areas.

3. A thread supply device according to claim 2, wherein the drive gearing comprises a transmission with adjustable rotational speed.

4. A thread supply device according to claim 2, wherein the warp beam is provided with bearing pins and the receiving frame is provided with bearing members which comprise bearing slits arranged radially with respect to the friction roll and in which are accommodated rotatably and displaceably the bearing pins of the warp beam.

5. A thread supply device according to claim 3, wherein the warp beam is provided with bearing pins and the receiving frame is provided with bearing members which comprise bearing slits arranged radially with respect to the friction roll and in which are accommodated rotatably and displaceably the bearing pins of the warp beam.

6. A thread supply device according to claim 1, wherein the warp beam is driven at its axis, the drive wheel means comprises a pinion being connected with said warp beam, and said drive means further having a drive unit which is connected with a regulating device which keeps the thread quantities delivered by the thread winding areas per revolution of the circular knitting machine constant irrespective of the momentary diameter of the thread winding areas.

7. A thread supply device according to claim 6, wherein the regulating device comprises an actual value element which senses the momentary diameter of the thread winding areas.

8. A thread supply device according to claim 6, wherein the regulating device comprises an actual value element which senses the momentary thread consumption.

9. A thread supply device according to claim 6, wherein the regulating device comprises an actual value element which senses the momentary thread tension.

10. A thread supply device according to claim 6, wherein the regulating device comprises a reference element which determines the average thread quantity delivered by the thread winding areas per revolution of the circular knitting machine.

11. A thread supply device according to claim 1, wherein the receiving frame comprises means for accommodating at least one replacement warp beam and associated drive means therefor.

12. A circular weft knitting machine, comprising: a needle carrier having knitting needles, cam means forming a plurality of knitting systems along said needle carrier, a drive for producing continuous relative rotary motion between the needle carrier and the cam means for moving said needles past said systems, said needles receiving threads at said systems for knitting purposes such that the same average quantities of thread are consumed at said systems during said relative rotary motion; a receiving frame; at least one warp beam rotatably mounted in said receiving frame; a plurality of adjacent thread winding areas provided on said warp beam, said thread winding areas having the same axial lengths and the same diameters and on each thread winding area being wound one of said threads, each thread being associated with one of said systems; thread guide means for guiding said threads from said thread winding areas on predetermined thread paths to said associated systems; and a drive means, said drive means gearing having drive wheel means coupled to said warp beam to positively drive the latter in such a way that the thread winding areas, irrespective of their momentary diameters, always supply to said systems the average thread quantities consumed thereby.

13. A thread supply device for a circular weft knitting machine having a needle carrier for knitting needles, cam means forming a plurality of knitting systems along said needle carrier, and a drive for producing a continuous relative rotary motion between the needle carrier and the cam means for moving said needles past said systems, said needles receiving threads at said systems for knitting purposes such that the same average quantities of thread are consumed at said systems during said relative rotary motion; a receiving frame; at least one warp beam rotatably mounted in said receiving frame; a plurality of adjacent thread winding areas provided on said warp beam, said thread winding areas having the same axial length and the same diameters and on each thread winding area being wound one of said threads, each thread being associated with one of said systems; thread guide means for guiding said threads from said thread winding areas on predetermined thread paths to said associated systems; drive means, said drive means having drive wheel means coupled to said warp beam to positively drive the latter in such a way that the thread winding areas, irrespective of their momentary diameters, always supply to said systems the average thread quantities consumed thereby; and a bearing device comprising frame members extending beyond the circular weft knitting machine, at least one warp beam being accommodated above the needle cylinder of the circular weft knitting machine.

14. A thread supply device for a circular weft knitting machine having a needle carrier for knitting needles, cam means forming a plurality of knitting systems along said needle carrier, and a drive for producing a continuous relative rotary motion between the needle carrier and the cam means for moving said needles past said systems, said needles receiving threads at said systems for knitting purposes such that the same average quantities of thread are consumed at said systems during said relative rotary motion; a receiving frame; at least one warp beam rotatably mounted in said receiving frame; a plurality of adjacent thread winding areas provided on said warp beam, said thread winding areas having the same axial length and the same diameters and on each thread winding area being wound one of said threads, each thread being associated with one of said systems; thread guide means for guiding said threads from said thread winding areas on predetermined thread paths to said associated systems; drive means, said drive means having drive wheel means coupled to said warp beam to positively drive the latter in such a way that the thread winding areas, irrespective of their momentary diameters, always supply to said systems the average thread quantities consumed thereby, said receiving frame comprises means for accommodating at least one replacement beam and associated drive means therefor; and automatic thread tying-in means for tying the threads of said warp beam to the threads of said one replacement warp beam.

15. A thread supply device according to claim 14, wherein the receiving frame comprises a guide device arranged in the region of said thread guide means, said thread tying-in unit being movable on said guide device from thread to thread or thread group to thread group.

16. A thread supply device for a circular weft knitting machine having a needle carrier for knitting needles, cam means forming a plurality of knitting systems along said needle carrier, and a drive for producing a continuous relative rotary motion between the needle carrier and the cam means for moving said needles past said systems, said needles receiving threads at said systems for knitting purposes such that the same average quantities of thread are consumed at said systems during said relative rotary motion; a receiving frame; at least one warp beam rotatably mounted in said receiving frame; a plurality of adjacent thread winding areas provided on said warp beam, said thread winding areas having the same axial length and the same diameters and on each thread winding area being wound one of said threads, each thread being associated with one of said systems; thread guide means for guiding said threads from said thread winding areas on predetermined thread paths to said associated systems; a drive means, said drive means having drive wheel means coupled to said warp beam to positively drive the latter in such a way that the thread winding areas, irrespective of their momentary diameters, always supply to said systems the average thread quantities consumed thereby, said receiving frame comprising means for accommodating at least one further warp beam and associated drive means, therefor; and thread exchange devices associated with the systems, said thread exchange devices having means for alternately supplying a thread from said at least one warp beam and from said one replacement warp beam, respectively.

* * * * *